US009551499B1

(12) United States Patent
Chwala

(10) Patent No.: US 9,551,499 B1
(45) Date of Patent: Jan. 24, 2017

(54) HINGE ASSEMBLY FOR SUPPORTING A FAN ON A ROOF

(75) Inventor: Kevin Robert Chwala, Barrington, IL (US)

(73) Assignee: Omni Containment Systems, LLC, Elgin, IL (US)

( * ) Notice: Subject to any disclaimer, the term of this patent is extended or adjusted under 35 U.S.C. 154(b) by 1577 days.

(21) Appl. No.: 12/657,918

(22) Filed: Jan. 29, 2010

Related U.S. Application Data

(63) Continuation-in-part of application No. 11/551,285, filed on Oct. 20, 2006, now abandoned.

(51) Int. Cl.
*F24F 7/06* (2006.01)
*F24F 7/02* (2006.01)
*E05D 11/10* (2006.01)

(52) U.S. Cl.
CPC ..... *F24F 7/02* (2013.01); *E05D 2011/1035* (2013.01)

(58) Field of Classification Search
CPC ..... F24F 7/02; F16C 11/06; E05F 1/12; B60J 7/1642; B60J 9/02; E05D 15/505; E05D 3/10; E05D 11/10; E05D 11/1007; E05D 11/1028; E05D 11/1071; E05D 2011/1035; E05D 2011/1092; Y10T 16/5472; Y10T 16/54; Y10T 16/54025; Y10T 16/540256; Y10T 16/540257; Y10T 16/5409; Y10T 16/54095
USPC ..... 454/341, 354, 367; 16/367, 247; 52/217; 49/248
See application file for complete search history.

(56) References Cited

U.S. PATENT DOCUMENTS 79,950 A * 7/1868 Carkeet ..... E05D 3/12 16/343
149,053 A * 3/1874 Miller ..... E05D 11/1007 16/344
203,123 A * 4/1878 Deblois ..... 49/193
415,086 A * 11/1889 Baker ..... E05D 11/1007 16/353
542,051 A * 7/1895 Heller ..... E05D 11/1007 16/344
783,184 A * 2/1905 Dwyer ..... E05D 11/1007 16/353
1,294,044 A * 2/1919 Buckwalter et al. ..... E05D 11/1007 16/351
1,294,301 A * 2/1919 Norton ..... E05D 11/1007 16/324
1,299,658 A * 4/1919 Barrs ..... E05D 11/1007 16/344
1,516,747 A * 11/1924 Maille ..... E05D 3/02 16/367
1,526,546 A * 2/1925 Holm ..... E05D 3/02 16/392
1,887,549 A * 11/1932 Ervin ..... E05D 3/10 16/367
1,903,379 A * 4/1933 Hall ..... E05D 3/10 16/367

(Continued)

*Primary Examiner* — Gregory Huson
*Assistant Examiner* — Martha Becton
(74) *Attorney, Agent, or Firm* — Adam K. Sacharoff; Much Shelist

(57) ABSTRACT

A buttressed hinge assembly or a flexible hinge assembly adjusts to fit a vent on a wall or a roof in order to hold a fan thereon, which fan is especially suitable for a restaurant roof or wall. The hinge assembly attaches to a roof or wall vent to hold the fan in a proper position, yet permits the fan to be easily moved for cleaning of vent and the fan.

11 Claims, 13 Drawing Sheets

(56) References Cited

U.S. PATENT DOCUMENTS 2,085,616 A * 6/1937 Voge ..... E05D 3/10 16/367
2,200,250 A * 5/1940 Atwood ..... 16/224
2,337,632 A * 12/1943 Winser ..... 454/145
2,754,537 A * 7/1956 Rose ..... F16B 12/32 16/367
2,875,678 A * 3/1959 Shepherd ..... F04D 29/646 454/355
3,305,163 A * 2/1967 Sheppard ..... F04D 29/626 415/201
3,665,661 A * 5/1972 Beckerer ..... 52/19
3,742,659 A * 7/1973 Drew ..... 52/19
3,791,279 A * 2/1974 Holt et al. ..... 250/384
3,896,595 A * 7/1975 Anghinetti et al. ..... 52/19
3,960,063 A * 6/1976 Siemes ..... F24F 13/24 181/224
3,976,024 A * 8/1976 Fillery ..... 114/203
4,038,911 A * 8/1977 Hart ..... 454/94
4,297,818 A * 11/1981 Anderson ..... 52/199
4,300,440 A * 11/1981 Holter ..... 454/78
4,357,735 A * 11/1982 Saint et al. ..... 16/224
4,415,197 A * 11/1983 Meyer ..... 296/216.02
4,433,506 A * 2/1984 Manning ..... 49/141
4,487,449 A * 12/1984 Igel et al. ..... 296/216.07
4,495,731 A * 1/1985 Sears ..... 49/402
4,519,645 A * 5/1985 Kelly et al. ..... 296/224
4,652,045 A * 3/1987 Hanley et al. ..... 296/221
4,655,365 A * 4/1987 Miller ..... F16J 13/18 105/377.07
4,660,251 A * 4/1987 Watabe ..... E05D 7/04 16/289
4,890,950 A * 1/1990 Yoo ..... 403/96
4,964,673 A * 10/1990 Lamparter ..... 296/216.02
4,986,028 A * 1/1991 Schneider et al. ..... 49/248
5,081,741 A * 1/1992 Aumercier ..... 16/238
5,329,871 A * 7/1994 Gibbs ..... B63B 29/04 114/363
5,400,993 A * 3/1995 Hamilton ..... F16M 11/00 248/279.1
5,493,880 A * 2/1996 Jang ..... B60R 25/066 16/239
5,735,086 A * 4/1998 Fordahl ..... 52/19
5,815,996 A * 10/1998 Granger ..... 52/202
5,816,909 A * 10/1998 Wunder ..... F24F 7/025 454/341
5,944,293 A * 8/1999 Loy ..... B64C 25/60 248/202.1
6,212,735 B1 * 4/2001 Daoud ..... 16/250
6,289,555 B1 * 9/2001 Nguyen et al. ..... 16/235
6,309,013 B1 * 10/2001 Staltmayer et al. ..... 296/214
6,346,042 B1 * 2/2002 Parker ..... 454/354
6,347,484 B1 * 2/2002 Swanger ..... 49/193
6,357,081 B1 * 3/2002 Bender ..... 16/201
6,394,539 B1 * 5/2002 Park ..... 296/216.02
6,397,432 B1 * 6/2002 di Vinadio ..... 16/242
6,421,877 B1 * 7/2002 Mih ..... 16/238
6,442,896 B1 * 9/2002 Chapin, III ..... 49/193
6,572,182 B2 * 6/2003 Lamparter et al. ..... 296/216.02
6,601,811 B1 * 8/2003 Van Lieshout ..... 248/282.1
6,609,750 B1 * 8/2003 Cauduro ..... 296/216.02
6,672,020 B1 * 1/2004 Cermola et al. ..... 52/200
6,688,682 B2 * 2/2004 Arthur et al. ..... 296/216.02
6,840,572 B2 * 1/2005 Sillanpåå ..... 296/215
7,232,370 B1 * 6/2007 Newell ..... 454/366
7,296,325 B1 * 11/2007 Putumbaka et al. ..... 16/361
7,581,793 B2 * 9/2009 Hartmann et al. ..... 297/463.1
2005/0059337 A1 * 3/2005 Jeffries ..... 454/145
2005/0159102 A1 * 7/2005 Seliger et al. ..... 454/356
2005/0268558 A1 * 12/2005 Cardine et al. ..... 49/349
2006/0001288 A1 * 1/2006 Thiele et al. ..... 296/50
2006/0208528 A1 * 9/2006 Tucker et al. ..... 296/146.11
2007/0175467 A1 * 8/2007 Liu ..... A47J 37/0704 126/25 R
2008/0139101 A1 * 6/2008 Bickel et al. ..... 454/136
2008/0276423 A1 * 11/2008 Wu ..... B60N 3/023 16/277
2009/0140228 A1 * 6/2009 Williams, Jr. ..... E05D 5/06 256/65.03
2009/0200825 A1 * 8/2009 Shimajiri ..... 296/37.8
2010/0102494 A1 * 4/2010 Duc et al. ..... 267/140.12
2010/0139043 A1 * 6/2010 Lin ..... E05D 11/087 16/319
2011/0047881 A1 * 3/2011 Bjorn et al. ..... 49/399
2011/0177279 A1 * 7/2011 Casteras ..... 428/53
2012/0233927 A1 * 9/2012 Sommer ..... 49/358
2013/0152340 A1 * 6/2013 Bannon ..... 16/237

* cited by examiner

HINGE ASSEMBLY FOR SUPPORTING A FAN ON A ROOF

CROSS REFERENCE TO RELATED APPLICATIONS

This application is a continuation in part of U.S. patent application Ser. No. 11/551,285, filed Oct. 20, 2006 now abandoned, filed by the same inventive entity.

This invention relates to a hinge assembly for supporting a fan on a roof and, more particularly, to a buttressed or flexible hinge assembly, which supports the fan on the roof, while providing for an easy cleaning procedure for both the fan and the vent on the roof.

BACKGROUND OF THE INVENTION

Ventilation is very important in a building. To that end, at least one fan may be installed in order to assist air circulation. In a large building, the fan is required to be quite powerful. This power requirement leads to large and heavy fans. Typically, such a fan is mounted over a vent on a roof. By moving air through the vent, both the vent and the fan will become contaminated. When a fan or a vent is contaminated, air flow is compromised.

Most hinge systems are fastened to the fan by attaching hardware in a very concentrated and limited area on the fan base and duct. This causes a great deal of stress in the affected area, which leads to equipment breakdown and damage to the fan housing. In fact, current hinge systems can be installed only on fans, which that have a configuration that matches up with those of the hinge system. These hinge systems are operable only with a small percentage of the fans in use today and cannot be modified to adapt to other fans.

It is thus desirable to clean the fan and improve the air flow. As the fan size increases, movement thereof becomes even more difficult, which further complicates the cleaning process. Movement of the fan for cleaning and service purposes must therefore be simplified.

Cleanliness is also very important in the restaurant business. The more easily such cleanliness can be achieved, the more profitable and efficient restaurant can be. Critical to achieving these desired advantages is providing effective and simplified access to areas which need to be cleaned. This is especially critical with the vents at the restaurant.

Because of new mandates requiring commercial food processing facilities and all restaurants to install a hinging system on their roof top ventilators, it is important for these businesses to find a system that can adapt to their specific needs. The only hinging systems available are compatible with just a small percentage of existing roof top ventilation systems. The effectiveness of these systems, and in many cases the possibility of installing them at all, is limited by a number of factors including the weight and dimensions of the fan, low grade material and components, which leads to a lack of durability, and a lack of versatility, meaning an inability to adapt to a variety of different situations that may be involved with hinge installation on any given fan.

Typically, a vent at a restaurant permits an exhaust to be withdrawn from the kitchen. Assisting the exhaust is usually a fan. This vent generally passes from the kitchen through the roof. Mounted on the kitchen roof over the vent is usually a fan. Through this vent, are generally passed grease and other cooking residue.

After a period of use, this vent and the fan become contaminated with that grease. Other cooking residue also becomes adhered thereto. This basically flammable residue is at least a fire hazard, or worse. Such residue can also attract undesirable microbes and illness causing bacteria. The closeness of such contamination to a food source is a clear danger to those food consumers and food handlers, who are at the restaurant.

It is thus necessary to clean both the vent and the fan after a period of use. While the fan is necessary for the vent to work, the fan causes many problems, when the time to clean the vent and the fan comes. Any device, which simplifies removal of such contamination and cleaning of the affected area, provides many great advantages. Still, there are many problems with such a cleaning process and the related device.

A first problem is that the fan must be moved, in order to clean the vent. A properly mounted fan is difficult to move and reinstall properly. The mounting for the fan must be solid enough to hold the fan, while leaving the fan easily movable for cleaning purposes. This fan must also be simple to reinstall in order for that fan to function with the exhaust vent in a proper fashion.

To that end, a restaurant fan is sometimes mounted on a hinge. The hinges of the prior art weaken the mounting of the fan, especially if the fan is easily movable. If the hinge is strong enough to firmly support the fan, the fan is not easily moved, and access to the vent becomes more complicated.

The hinge kits of the prior art are constructed from thin gauge steel and inadequate hardware. This leads to premature equipment failure and can cause the fan to overextend or even fall off of the duct. Most hinges cannot support the weight of heavier fans.

Current hinges use holding devices such chains, cables, or similar devices to prevent fans from falling backwards. These components are the source of a number of problems. First, those holding devices, especially the chains, have a tendency to fail. When they do fail, the fan can fall backward violently, damaging the fan and posing an injury risk. They must be precisely measured and installed, adding a time-consuming factor to the installation process. Also they are a major inconvenience and obstruction to workers that clean and service the fan.

With the many variations in a roof and the plurality on different fan structures, adjustability of the hinge is also desired. Yet obtaining adjustability can interfere with both strength and access to both the fan and the vent. Emphasizing one desired feature can interfere with the other.

Thus, it is very desirable to provide access to the vent, while supporting the fan on the roof at the same time. It is also very useful if the hinge assembly can be adjustable.

SUMMARY OF THE INVENTION

Among the many objectives of this invention is the provision of a buttressed hinge assembly, which supports a fan on a roof, while providing for an easy cleaning procedure for both the fan and the vent on the roof.

A further objective of this invention is the provision of a buttressed hinge assembly, which greatly simplifies cleaning of a vent for a restaurant.

Yet a further objective of this invention is the provision of a buttressed hinge assembly, which greatly simplifies cleaning of a fan.

A still further objective of this invention is the provision of a buttressed hinge assembly, which is easily adjustable on a roof.

Another objective of this invention is the provision of a buttressed hinge assembly, which is strong.

Yet another objective of this invention is the provision of a buttressed hinge assembly, which support the fan.

Still, another objective of this invention is the provision of a buttressed hinge assembly, which simplifies cleaning of the fan.

Also, an objective of this invention is the provision of a buttressed hinge assembly, which simplifies cleaning of the vent.

A further objective of this invention is the provision of a flexible hinge assembly with a rotational lower bar which can accommodate a variety of fan to duct combinations.

A still further objective of this invention is the provision of a flexible hinge assembly which can balance the weight of the fan behind the fan base, the fan, and the vent wall.

Another provision of this invention is the provision of a flexible or buttressed hinge assembly which eliminates the safety concerns of removing the fan from the vent wall and placing it directly on a roof top.

These and other objectives of the invention (which other objectives become clear by consideration of the specification, claims and drawings as a whole) are met by providing a buttressed hinge assembly, which adjusts to fit a roof in order to hold a fan thereon, which is especially suitable for a restaurant roof.

BRIEF DESCRIPTION OF THE DRAWINGS

Throughout the figures of the drawings, where the same part appears in more than one figure of the drawings, the same number is applied thereto.

DESCRIPTION OF THE PREFERRED EMBODIMENTS

Figure 1:
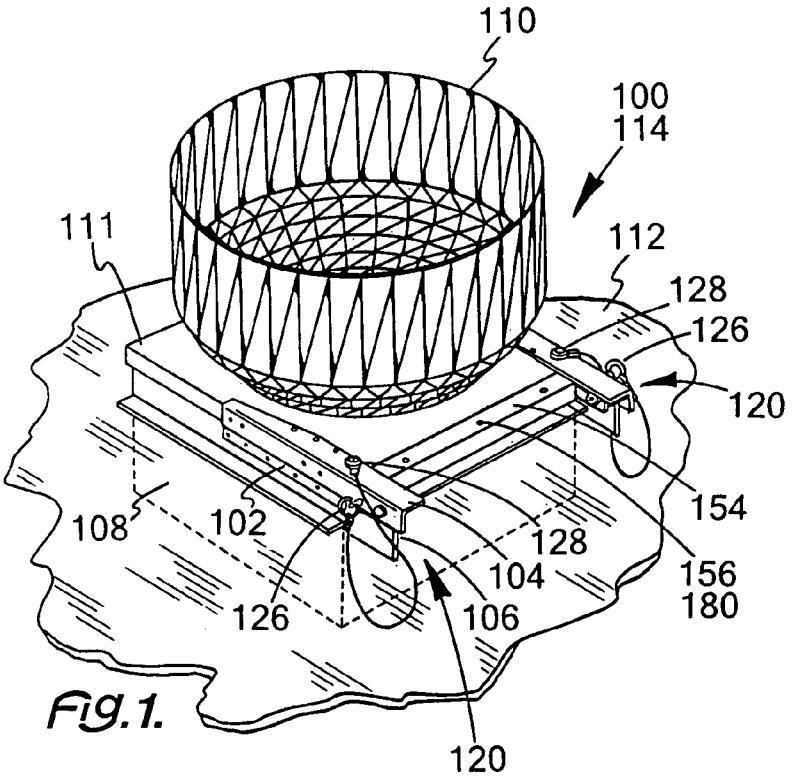
FIG. 1 depicts a perspective view of a buttressed hinge assembly 100 of this invention for supporting a fan 110 on a roof 112 in a closed hinge position 114.
Figure 2:
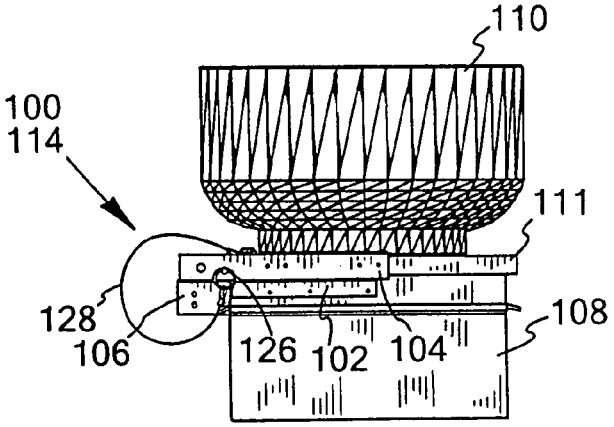
FIG. 2 depicts a side view for buttressed hinge assembly 100 of this invention based on FIG. 1.
Figure 3:
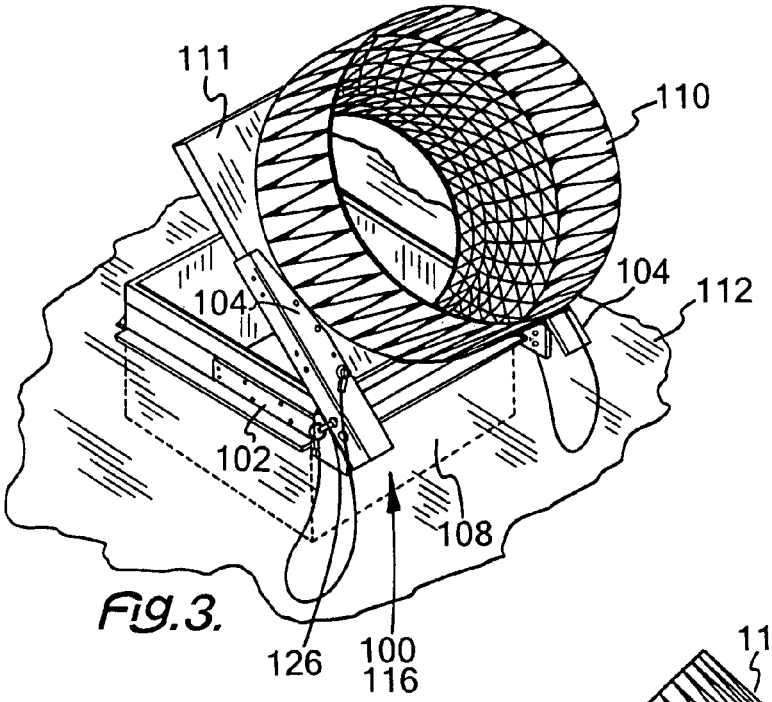
FIG. 3 depicts a perspective view of buttressed hinge assembly 100 of this invention in partially opened hinge position 116.
Figure 4:
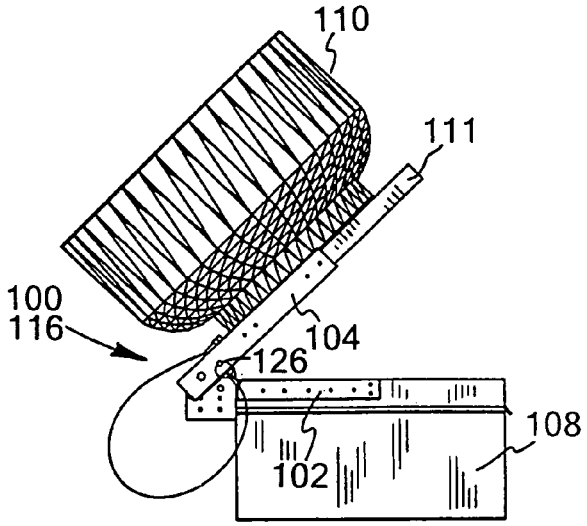
FIG. 4 depicts a side view for buttressed hinge assembly 100 of this invention based on FIG. 3.
Figure 5:
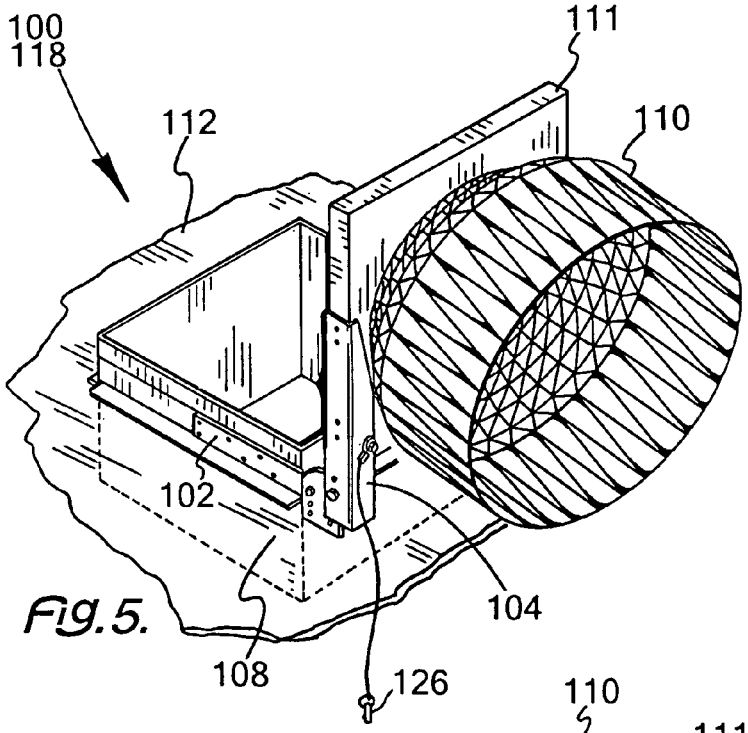
FIG. 5 depicts a perspective view of buttressed hinge assembly 100 of this invention in fully opened hinge position 118.
Figure 6:
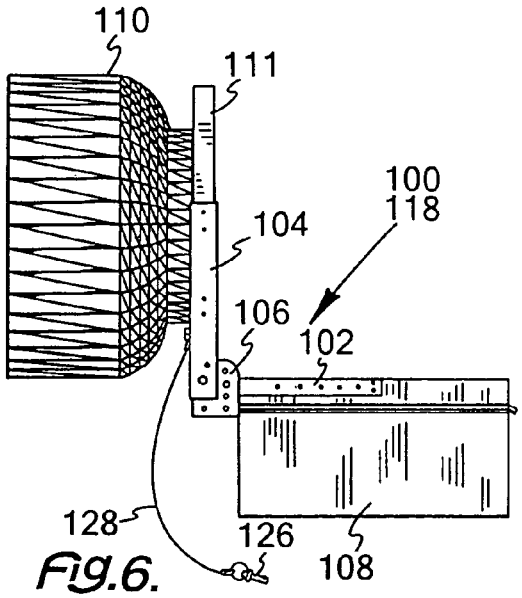
FIG. 6 depicts a side view for buttressed hinge assembly 100 of this invention based on FIG. 5.
Figure 7:
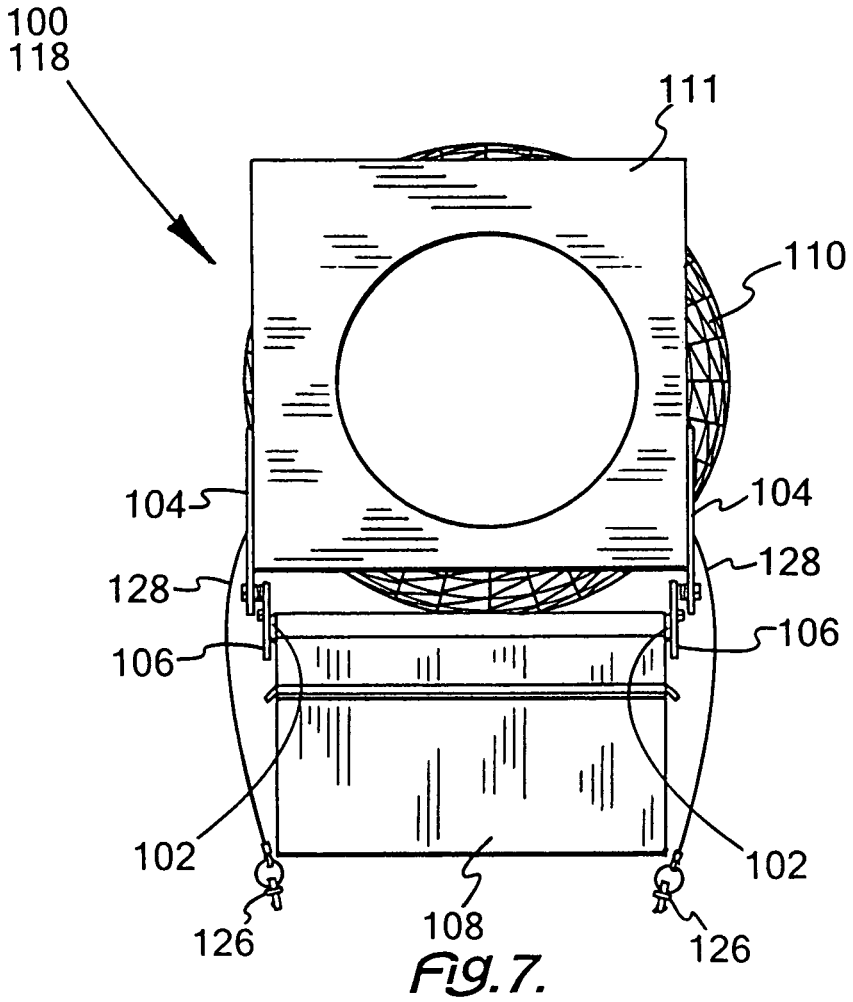
FIG. 7 depicts a bottom view of fan base 111 for buttressed hinge assembly 100 of this invention.

In accordance with the present invention, the buttressed hinge assembly is depicted. The buttressed hinge assembly consists of a mounting support bar and a fan support bar connected together through a hinge. The fan support bar is also connected to the fan in order to hold the fan in a position and within a relationship to the roof duct. The hinge allows that fan to be securely held in multiple positions to provide easier access to the fan and duct walls during cleaning, while at the same providing a strong support for the fan as it works in a proper position on the roof.

This hinge is fastened and clamped over a much larger area of the fan base and duct. This causes stress to be more evenly distributed, which protects the fan housing and prolongs the life of the hinge system. This hinge can be installed on most fans and has a number of adjustment capabilities that allow it to be installed on almost all other fan duct combinations.

This hinge is preferably made of rust resistant heavy grade steel and the assembly thereof is accomplished with rust resistant hardware. Preferably, the hinge is powder coated to resist rust. Hardware is preferably made from hardened stainless steel. This hinge uses a holding pin to lock the fan in place. It is strong and easy to install, and is completely out of the way of service providers. An additional benefit is that the fan can be locked into position at a 45-degree angle as well as a 90-degree angle, which makes it easier for service personnel to clean and service it. This hinge can handle fans weighing about 200 to 300 kilograms or more.

The hinge assembly of this invention is extremely useful for holding a heavy fan of any type in a desired position over a vent. The fan can be easily moved and support, so that both the fan and the vent are more easily cleaned. This is especially effective, for cleaning a fan on the roof of a restaurant, where grease from the cooking processes complicate the cleaning process.

The buttressed hinge assembly and the flexible hinge assembly provide another great safety feature. Previously, the fan would be completely removed from the vent and placed on the roof top. This method provided many safety concerns. First, the power conduit leads to the fan would be damaged, causing exposed wires or shorted wires. The damage from the power conduits would be caused by awkward tensions on the conduit when removing the fan unhinged. These damaged conduits cause great fire hazards when placed on a roof top which under most circumstance are greasy due to exhaust fan smoke and grease discharge. Furthermore, place heavy fans on the roof top caused damage and punctures or holes in the roof top. The fan of this invention eliminates all of these safety concerns.

Referring now to FIG. 1, FIG. 2, FIG. 3, FIG. 4, FIG. 5, FIG. 6, and FIG. 7, the structure of buttressed hinge assembly 100 of this assembly can be clearly seen. Buttressed hinge assembly 100 has mounting support bar 102 and fan support bar 104. Buttressed hinge assembly 100 has mounting support bar 102 and fan support bar 104, which are mutually connected through their attachment on hinge locking plate 106 to form hinge 120.

Mounting support bar 102 is designed to attach to the duct or vent wall 108 on a roof 112. Vent wall and duct are used interchangeable and refer to the same component. Fan support bar 104 is also designed to attach to fan base 111, which supports fan 110 and provide for a temporary hinged movement of the same. Hinge locking plate 106 is between mounting support bar 102 and fan support bar 104. Hinge locking plate 106 provides a cam action between mounting support bar 102 and fan support bar 104.

Hinge locking plate 106 includes adjustment apertures 158, in order provide flexibility in the positioning of mounting support bar 102. Hinge bolt 162 permits movement of fan support arm 104 relative to mounting support bar 102. Plate bolt 164 secures mounting plate 106 to mounting support bar 102. Hinge nut 166 secures hinge bolt 162 in position to movably connect fan support arm 104 and mounting support bar 102. Plate nut 168 secures hinge locking plate 106 to mounting support bar 102 through plate bolt 164.

Figure 13:
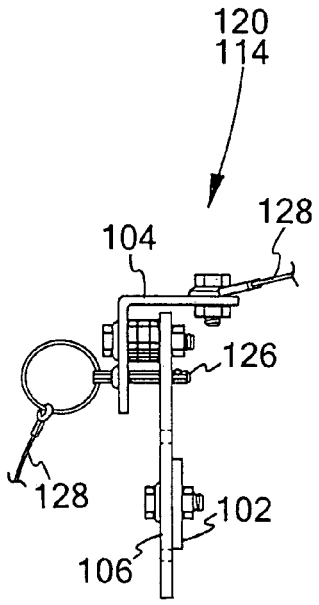
FIG. 13 depicts a rear plan view of side hinge 120 for buttressed hinge assembly 100 of this invention based on FIG. 3.
Figure 12:
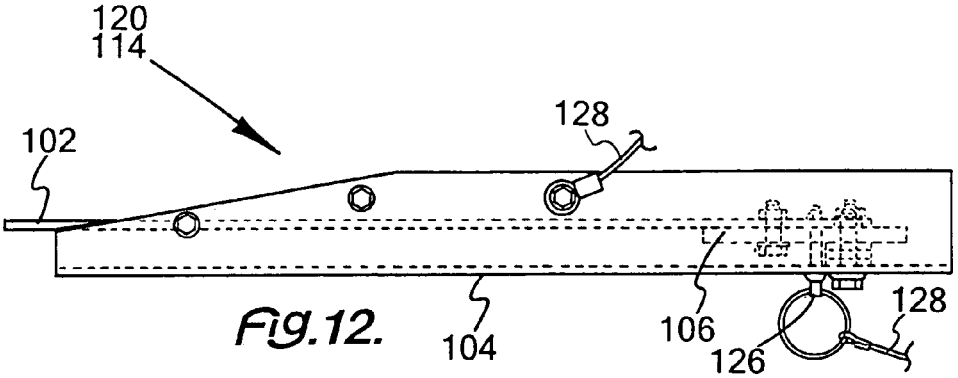
FIG. 12 depicts a top plan view of side hinge 120 for buttressed hinge assembly 100 of this invention based on FIG. 3.

If desired, one or more of shim 160 (FIG. 7, FIG. 12 and FIG. 13) may be placed on hinge bolt 162 in order to space fan support arm 104 from mounting support bar 102. This is another factor providing flexibility and adjustability to the buttressed hinge assembly 100, especially in the positioning of fan 110 relative to vent wall 108.

As an option, mounting bar brace 154 may connect a pair of mounting support bars 102 in a U-shape. The connection is by welding, bolting or other suitable fasteners. This structure may add strength to the buttressed hinge assembly 100. So it is possible that mounting bar brace 154 may include brace apertures 156, which can receive fasteners 142 in order to secure mounting bar brace 154 and the pair of mounting support bars 102 to the vent wall 108.

Adding FIG. 8, FIG. 9, FIG. 10, FIG. 11, FIG. 12, and FIG. 13 to the consideration, along the length of mounting support bar 102 is a series of mounting bar securing apertures 140. Mounting bar securing apertures 140 are designed to cooperate with fastening device 142 (FIG. 14); in the form of hinge bolt 162, plate bolt 164, hinge nut 166 and plate nut 168; to secure the buttressed hinge assembly 100 to the fan 110.

Figure 9:
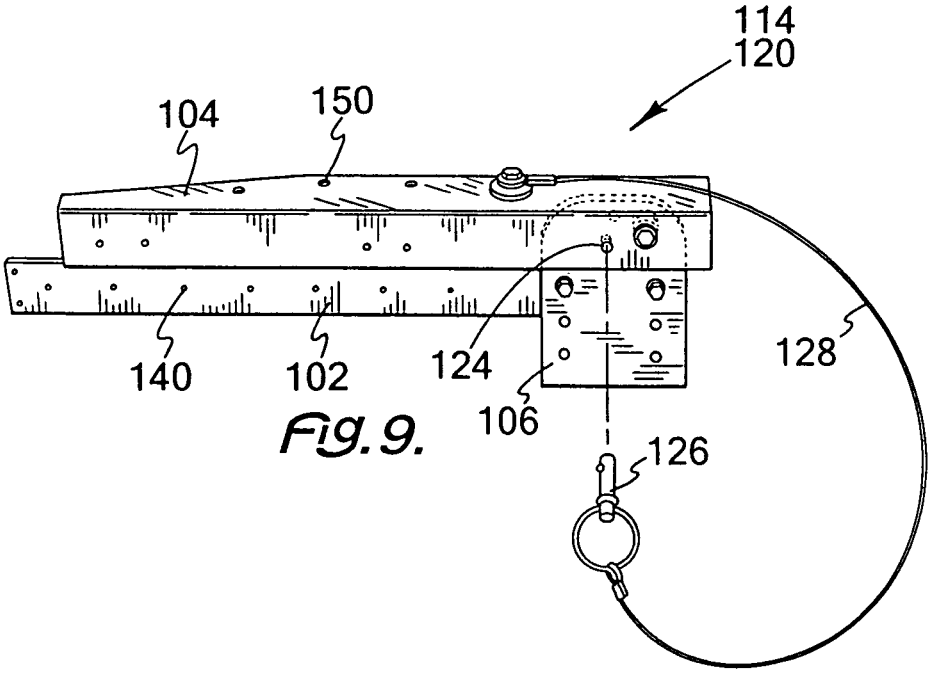
FIG. 9 depicts a perspective view of side hinge 120 for buttressed hinge assembly 100 of this invention based on FIG. 1.
Figure 10:
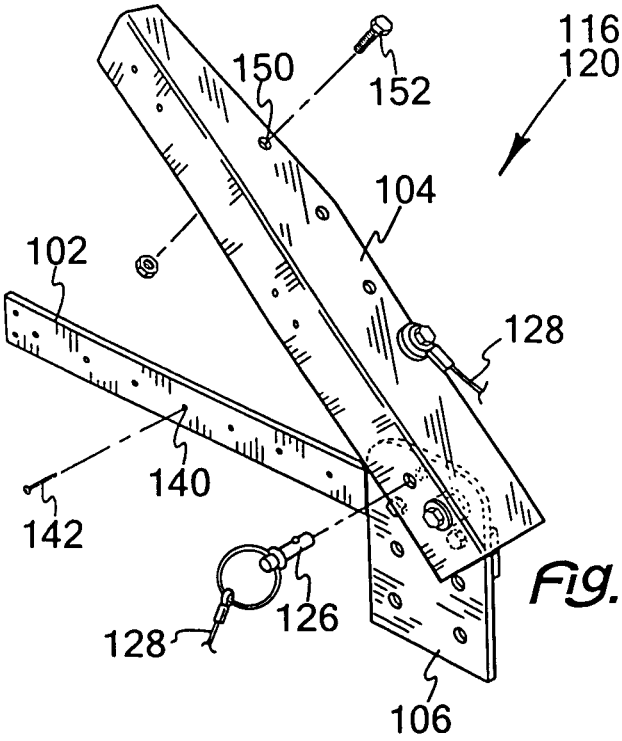
FIG. 10 depicts a perspective view of side hinge 120 for buttressed hinge assembly 100 of this invention based on FIG. 3.
Figure 11:
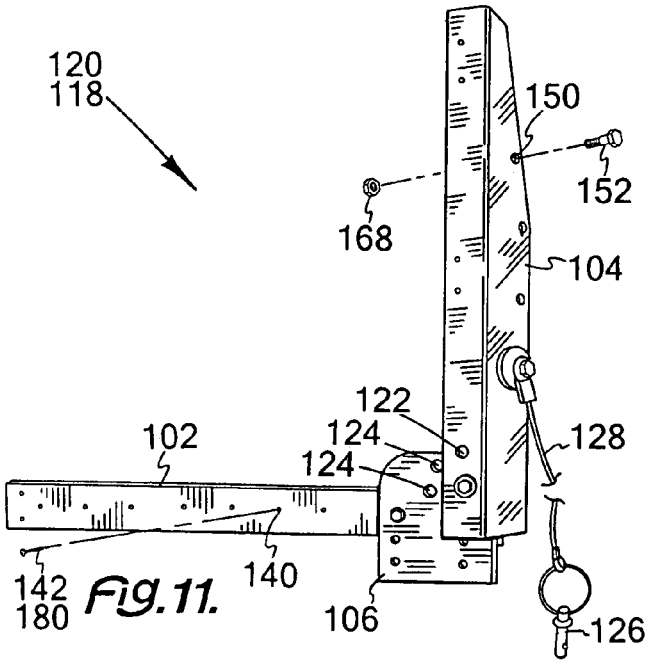
FIG. 11 depicts a perspective view of side hinge 120 for buttressed hinge assembly 100 of this invention based on FIG. 5.

More particularly, mounting support bar 102 is secured with plate bolt 164 and plate nut 168 to duct wall 108 in a secure and stable manner as in FIG. 9. Mounting bar securing apertures 140 cross a majority of the length of mounting support bar 102 so that stress from the weight of the fan 110 is not concentrated in one area. This increases the life and efficiency of buttressed hinge assembly 100.

In a similar fashion hinge 162 and hinge nut 164 cooperate to join fan support bar 104 and mounting support bar 102 in at least a partially rotational relationship. Mounting support bar 102 is fixed to vent wall 108, with fan support bar 104 movable relative thereto, so that fan 110 is movable for cleaning and other purposes.

Figure 8:
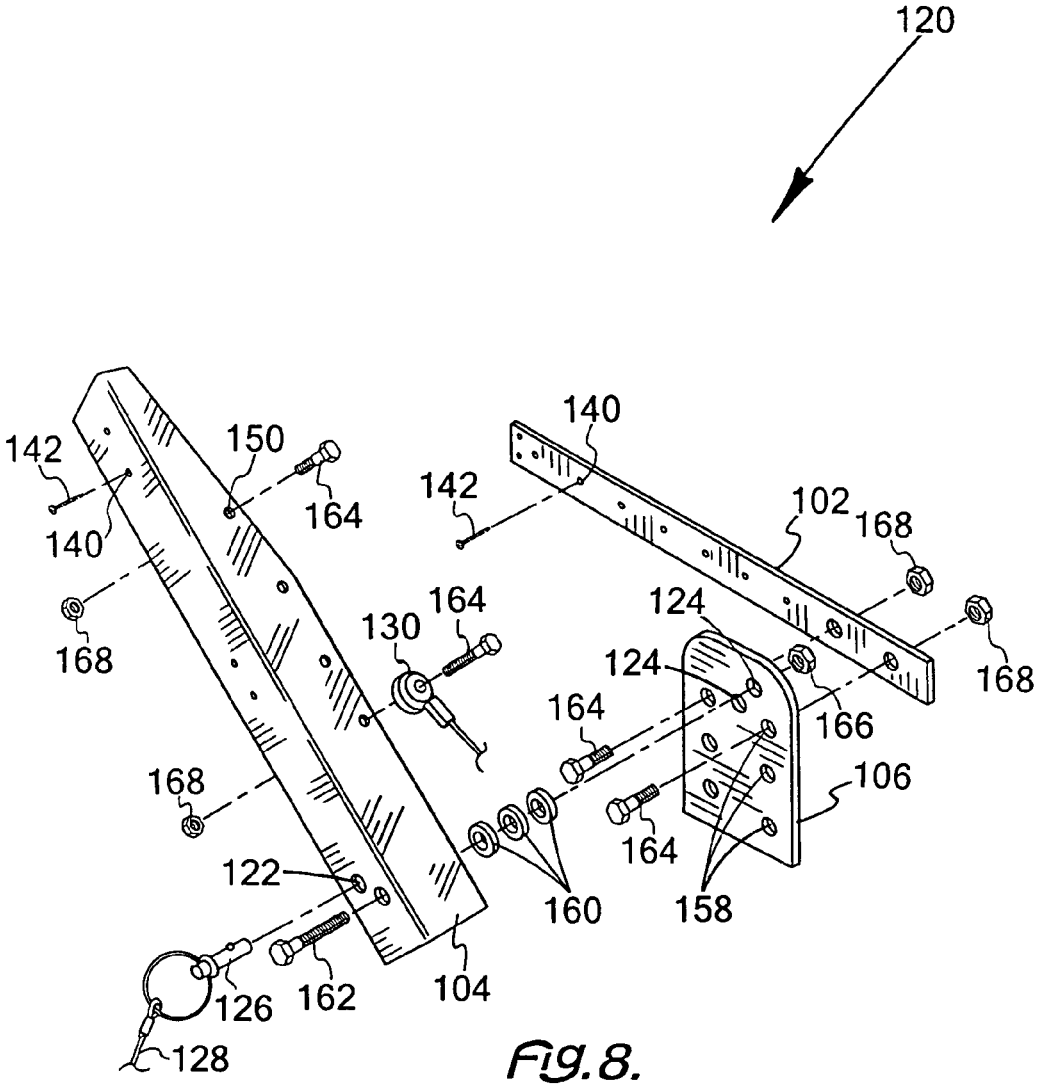
FIG. 8 depicts an exploded, perspective view of a buttressed hinge assembly 100 of this invention with fan 110 in a partially opened hinge position 116.

Along the length of fan support bar 104 is a series of fan support bar securing apertures 150. Fan support bar securing apertures 150 are designed to cooperate with fan fastening device 152 to secure fan 110 to fan support bar 104 in a secure and stable attachment as shown in FIG. 8. Fan support bar securing apertures 150 cross a majority of the length of fan support bar 104 so that the stress from the weight of the fan 110 is not concentrated in one area, thus increasing the life and efficiency of buttressed hinge assembly 100. This factor also increases the flexibility of buttressed hinge assembly 100 because heavier fans can be supported.

Furthermore, hinge 120 and locking pin 126 allow fan 110 to be repositioned in order to facilitate cleaning. Locking pin 126 is held to fan support bar 104 by flexible line 128. Oppositely disposed form locking pin 126, line fastener 130 cooperates with a holding device such as a rivet or a plate nut 168 and a plate bolt 164 in order to hold flexible line 128 on fan support bar 104. However, fan 110 can be moved, but does not have to be removed from hinge 120, thus making it much easier to clean both fan 110 and duct wall 108.

Once mounting support bar 102 is securely fastened to duct wall 108, fan support bar 104 can be locked in place at either a 45-degree angle (partially opened hinge position 116) or a 90-degree angle (fully opened hinge position 118). Hinge 120 allows for this variation in position. On hinge 120 are hinge locking pin apertures 122 and on fan support bar 104 are fan support bar locking pin apertures 124.

The user places fan 110 at either the 45-degree or 90-degree position and aligns fan support bar locking pin aperture 124 and hinge locking pin aperture 122 and secures the position by sliding locking pin 126 through the thus aligned apertures. With each set of apertures either the partially opened hinge position 116 or the fully opened hinge position 118 may be set as desired.

Figure 14:
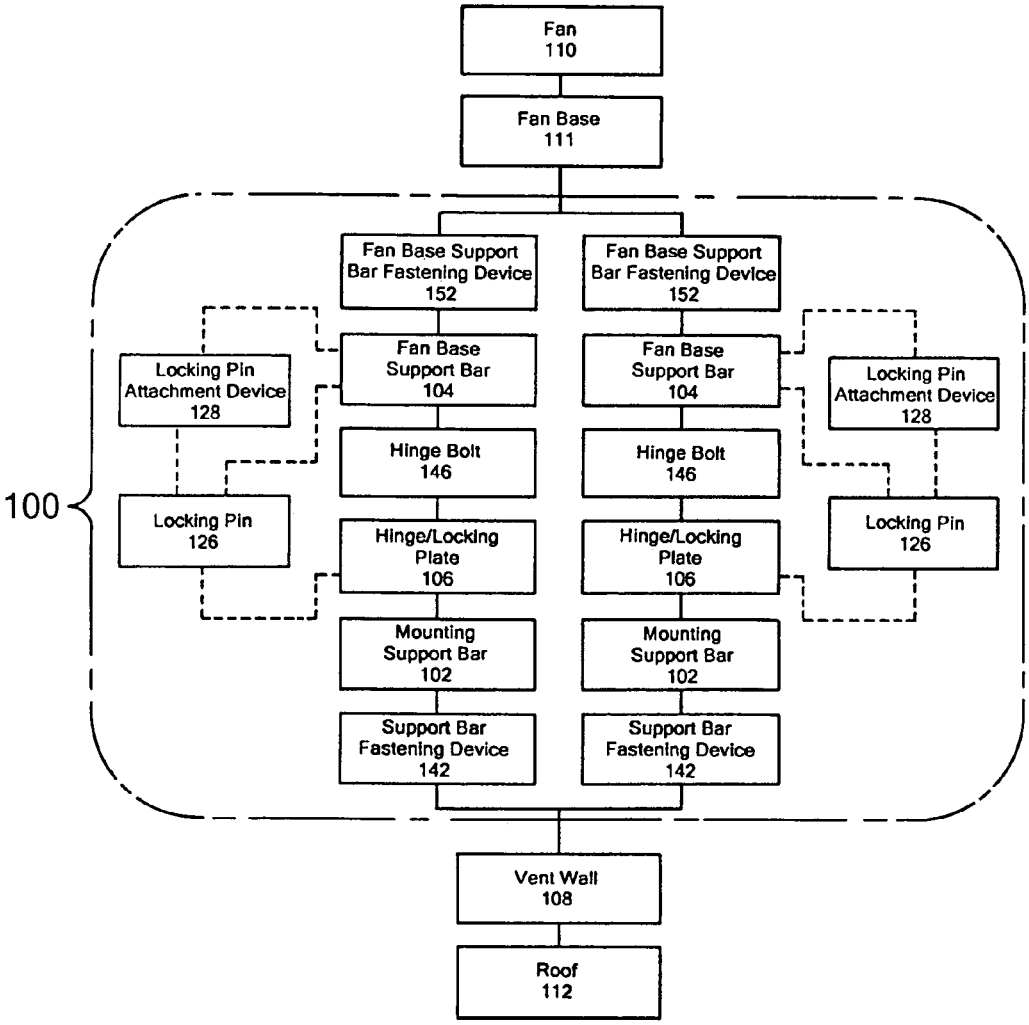
FIG. 14 depicts a block diagram of buttressed hinge assembly 100 of this invention, depicting a variety of hinge structures permitting an efficient use thereof.
Figure 15:
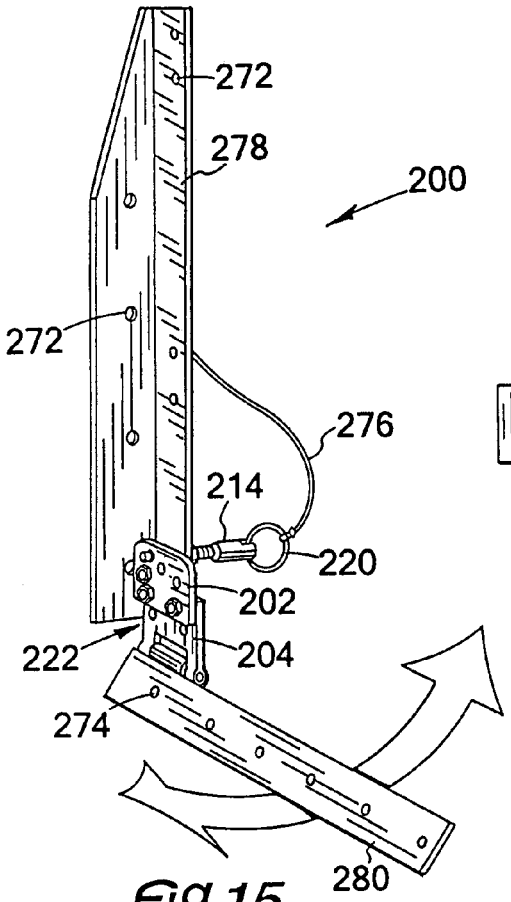
FIG. 15 depicts a perspective view of flexible hinge assembly 200 of this invention showing the swing adjustment functionality of mounting support bar 102.

With FIG. 14, a multitude of variations may be seen for buttressed hinge assembly 100 as set forth in previous figures. Mounting support bar 102 and fan support bar 104, combine with appropriate mounting devices or fasteners, so that fan 110 may be secured to roof 112 in a suitable fashion, which in turn permits fan 110 to provide the desired exhaust, while buttressed hinge assembly 100 permits support, movement and cleaning of fan 110 and vent wall 108. Inherently, the vent formed by vent wall 108 can also be cleaned.

As shown in FIG. 14, a series of mounting bar securing apertures 140 permit flexibility in attaching fan 110. Mounting bar securing apertures 140 are designed to cooperate with fastening device 142; which can be used in place of hinge bolt 162, plate bolt 164, hinge nut 166, and plate nut 168; to secure mounting support bar 102 to duct wall 108 in a secure and stable manner as in FIG. 9. Mounting bar securing apertures 140 cross a majority of the length of mounting support bar 102 so that stress from the weight of the fan 110 is not concentrated in one area. This increases the life and efficiency of buttressed hinge assembly 100.

Now adding FIG. 15, FIG. 16, FIG. 17, FIG. 18, and FIG. 19 to the consideration, flexible hinge assembly 200 can be clearly seen. In this embodiment, hinged mounting support bar 280 and angled fan support bar 278 attach as previously described in the earlier embodiment. Hinged mounting support bar 280 has mounting support bar attachment apertures 274 which cooperate with attachment fasteners to attach the hinged mounting support bar 280 to the vent wall 108. While angled fan support bar 278 has fan support bar attachment apertures 272 which cooperate with attachment fasteners to attach the angled fan support bar 278 to the fan base 111. Angled fan support bar 278 is angled at the upper end to accommodate the radius of the fan 110. Hinged mounting support bar 280 has the hinging flexibility seen in FIG. 15. This flexibility accommodates a wide range of fan to duct combinations.

Hinge 222 is attached between angled fan support bar 278 and hinged mounting support bar 280. Hinge 222 has a hinged locking plate 202 and hinge plate 204. Angled fan support bar 278 has securing aperture 228 which cooperates with securing bolt 224, securing nut 226, and hinged locking plate aperture 230 to securely connect angled fan support bar 278 to hinged locking plate 202. Hinged locking plate 202 has threaded locking plate apertures 206 while hinge plate 204 has hinge plate apertures 208.

Hinged locking plate 202 serves as a cam locking plate. Hinge plate 204 has a series of attachment apertures 240 which cooperate and align with hinged locking plate apertures 230 and attachment fasteners 242 to secure hinged locking plate 202 to hinge plate 204. The two component system of hinged locking plate 202 and hinge plate 204 provides even greater flexibility for height adjustment to accommodate a variety of fan to duct combinations. The series of attachment apertures 240 provides the height adjustment.

On hinged mounting support bar 280 is pin collar 210. Pin collar 210 cooperates and aligns with hinge plate 204. Hinge pin 212 inserts through collar apertures 286 and hinge plate apertures 208 to secure hinged mounting support bar 280 to the hinge plate 204 in a pivotal relationship. This pivotal relationship provides great flexibility to accommodate a variety of fan to duct combinations.

On angled fan support bar 278 is threaded fan support bar aperture 216. Threaded fan support bar aperture 216 aligns and cooperates with threaded locking plate apertures 206, spring loaded threaded locking pin 214, and threaded locking pin nuts 218 to secure the fan support bar to the hinged locking plate 202 in a secure but releaseable relationship. This cooperative relationship allows fan base 111 to be secured in partially open position 254, fully open position 256, locking position 252, or closed position 260 and provides great efficiency in the cleaning and service process of the fan to which it is mounted. Spring loaded threaded locking pin 214 has an optional tether 276 which securely attaches it to the flexible hinge assembly 200.

Spring loaded threaded locking pin 214 has a release ring 220 which is spring loaded. Release ring 220 allows a user to pull the release ring outward and release the connection between the angled fan support bar 278 and the hinged locking plate 202 in a safe and efficient manner. The release of threaded locking pin 214 allows the fan base 111 to cover and protected vent wall 108.

Figure 16:
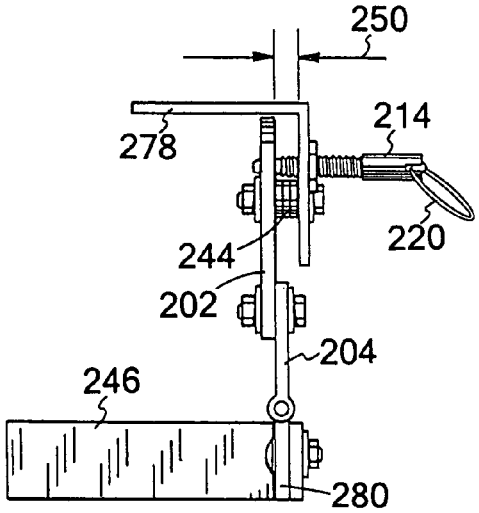
FIG. 16 depicts a front plan view of flexible hinge assembly 200 in narrow width adjustment 250.
Figure 17:
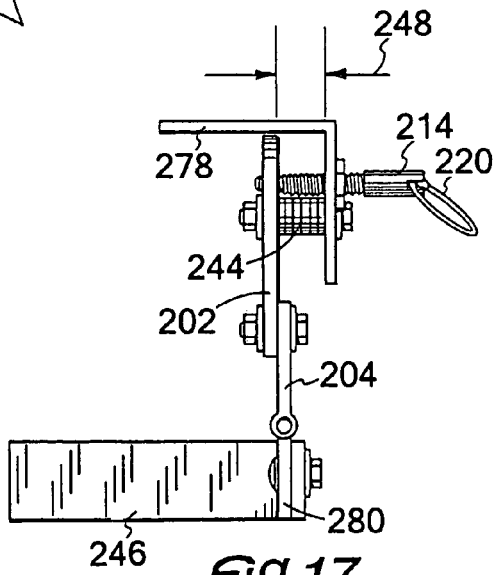
FIG. 17 shows a front plan view of flexible hinge assembly 200 in wide width adjustment 248.
Figure 18:
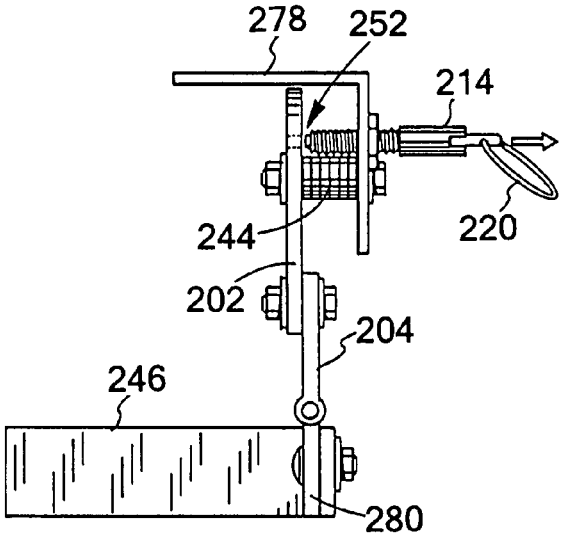
FIG. 18 shows a front plan view of flexible hinge assembly 200 with spring loaded threaded locking pin 214 withdrawing from locking position 252.
Figure 19:
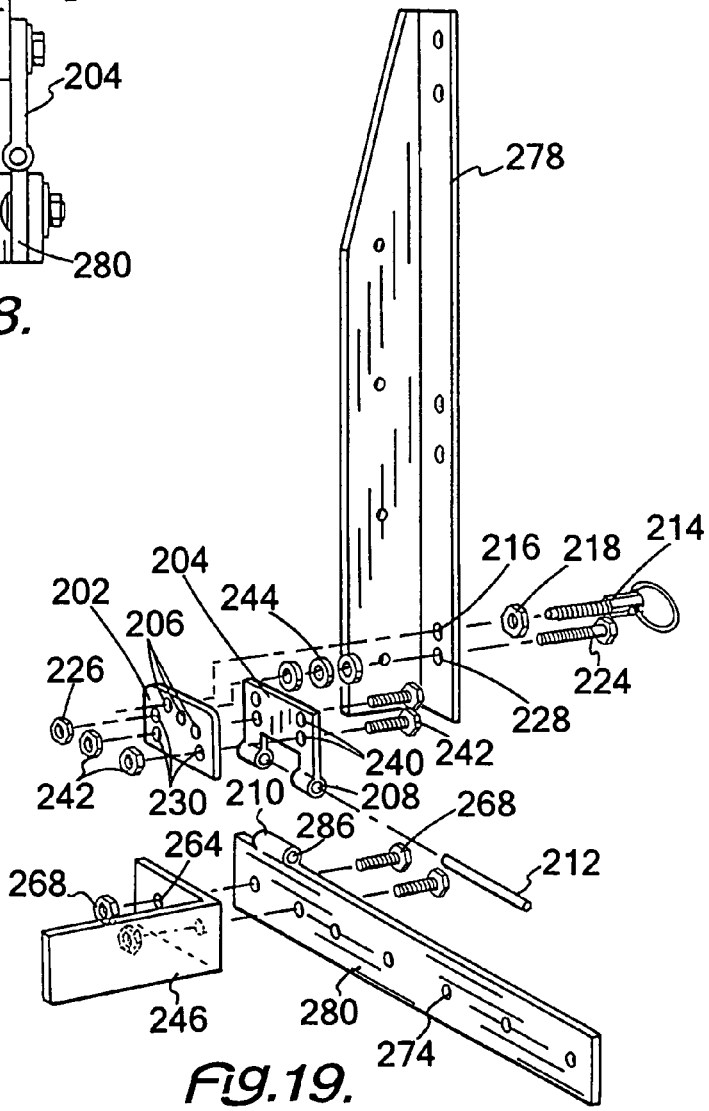
FIG. 19 depicts an exploded perspective view of flexible hinge assembly 200 of this invention.

Referring specifically to FIG. 16, FIG. 0.17, and FIG. 18, the function of adjustment shims 244 can be clearly seen. Between angled fan support bar 278 and hinged locking plate 202 is a series of adjustment shims 244 which are preferably made of nylon but any other suitable material can be used. Adjustment shims 244 can be added or removed to increase or decrease the space between angled fan support bar 104 and hinged locking plate 202. Adjustment shims 244 provide greater flexibility and allow for wider or narrower fan to duct combinations. If fan base 111 is wider than duct 108, more adjustment shim 244 will be needed to fill the increased space and accommodate this combination. If fan base 111, is not significantly wider than duct 108, then fewer adjustment shims 244 will be needed to accommodate this situation.

Spring loaded threaded locking pin 214 has to be adjusted as the number of adjustment shims 244 are adjusted. In FIG. 16, when fewer adjustment shims 244 are used, spring loaded threaded locking pin 214 does not have to be screwed further into threaded locking plate aperture 206 and threaded fan support bar aperture 216. In contrast, when more adjustment shims 244 are used, spring loaded threaded locking pin 214 has to be screwed further into threaded apertures 206 and 216 to accommodate the added distance. Spring loaded threaded locking pin 214 is secured into position by threaded locking pin nut 218.

Referring specifically to FIG. 18, spring loaded locking pin 218 is withdrawing from locking position 252. Once the spring loaded locking pin 218 is withdrawn, the angled fan support bar 278 can be moved into another position and secured again by spring loaded locking pin 218.

Figure 20:
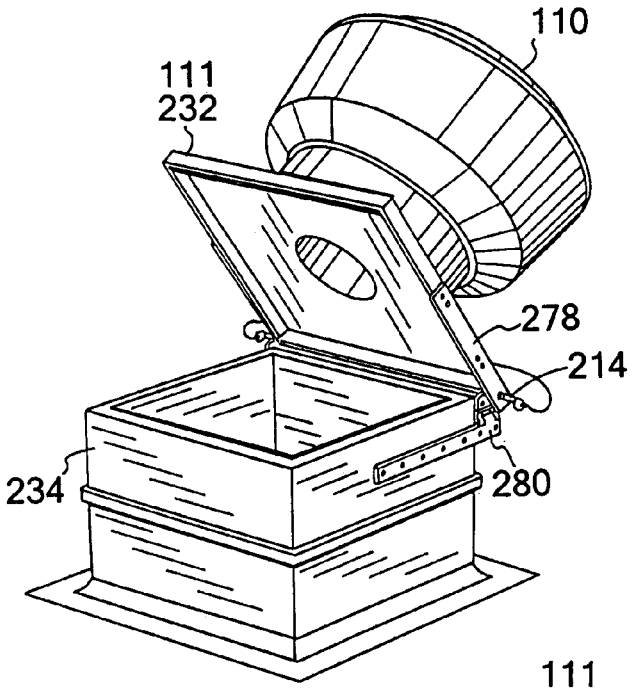
FIG. 20 depicts a frontal perspective view of flexible hinge assembly 200 installed on square vent wall 234.
Figure 21:
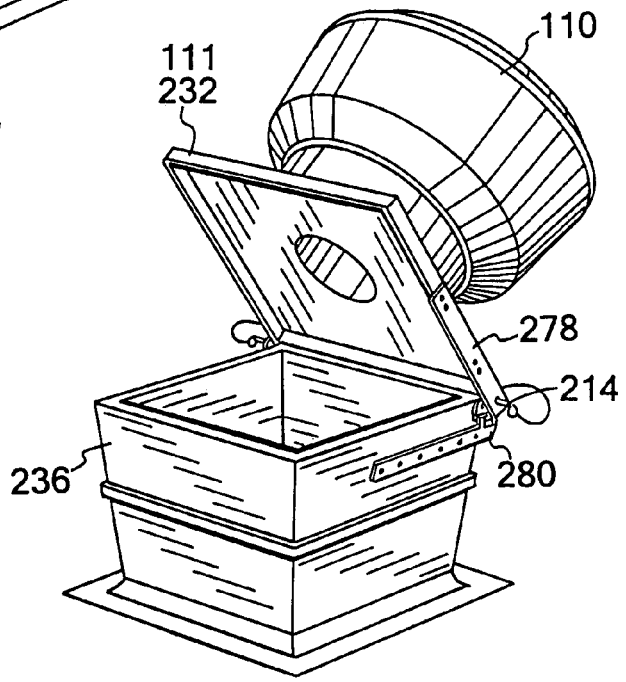
FIG. 21 depicts a frontal perspective view of flexible hinge assembly 200 installed on tapered vent wall 236.
Figure 22:
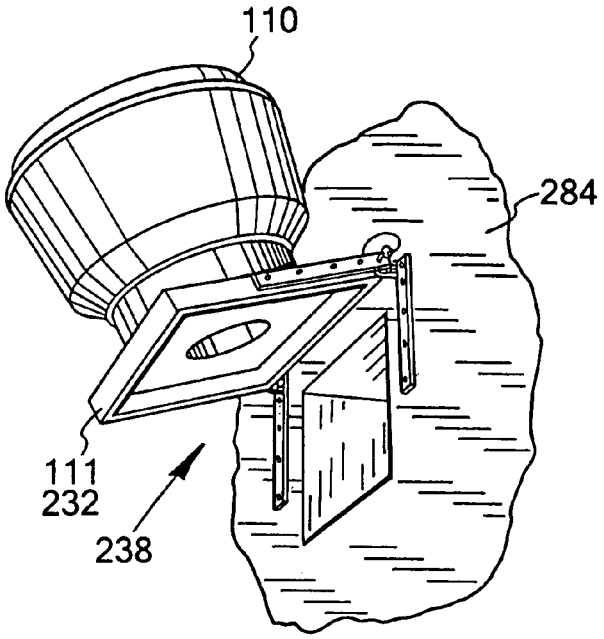
FIG. 22 depicts a frontal perspective view of flexible hinge assembly 200 accommodating wall mount configuration 238.

Now adding FIG. 20, FIG. 21, and FIG. 22 to the consideration, the advantages of hinge 222, hinged locking plate 202, hinge plate 204 and hinged mounting support bar 280 can be clearly seen. In the industry, there are a variety of fan to duct combinations. In FIG. 20, square fan base 232 fits substantially squarely on square vent wall 234. In these combinations, hinge 222 remains substantially vertical and little angular movement of hinged mounting support bar 280 is required.

However in FIG. 21, square fan base 232 is broader than tapered vent wall 236. In this fan to duct combination, hinge 222 allows hinged mounting support bar 280 to angle inward to obtain a secure connection between the square fan base 232 and tapered vent wall 236.

In FIG. 22, wall mount configuration 238 can be clearly seen. In wall mount configuration 238, hinged mounting support bar 280 moves 90 degrees and rests on the top of vent wall 108. Wall mount configuration 238 helps to accommodate a wide variety of wall mounted ducts 108.

Figure 23:
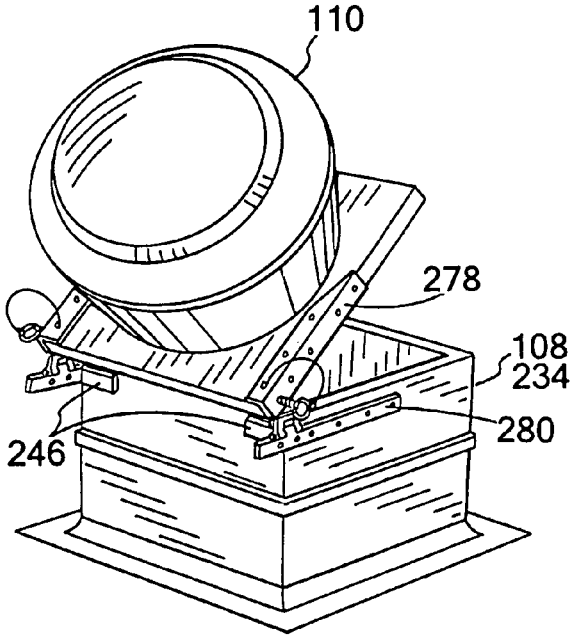
FIG. 23 depicts a rear perspective view of flexible hinge assembly 200 installed on square vent wall 334 with support brace 246 reinforcement.

Adding FIG. 23 to the consideration, an optional feature of flexible hinge assembly 200 can be clearly seen. Support brace 246 aids in supporting hinged mounting bar 280 and hinged locking plate 202 when fan 110 is in partially open position 254 or fully open position 256. Support brace 246 acts as a stabilizing component when dealing with the weight of fan 110.

Support brace 246 has support brace apertures 264 while hinged mounting support bar 280 has mounting support bar attachment apertures 274. Apertures 264 and 274 cooperate with support brace fasteners 268 to securely attach support brace 246 to hinged mounting support bar 280. In this embodiment, nuts bolts are used as support brace fasteners 268. However, support brace fastener 268 can be any other suitable fastener which can securely fasten the support brace 246 to the hinged mounting support bar 280.

Also, the positioning of hinged locking plate 202 can be clearly seen in FIG. 23. Hinged locking plate 202 is positioned behind the fan 110, fan base 111, and vent wall 108. This positioning allows for the weight of the fan to be balanced behind the fan 110, fan base 111, and vent wall 108 but not on the vent wall 108. Due to the enormous weights of fan 108, this position helps to manage the weight, as fan 108 is moved.

Figure 24:
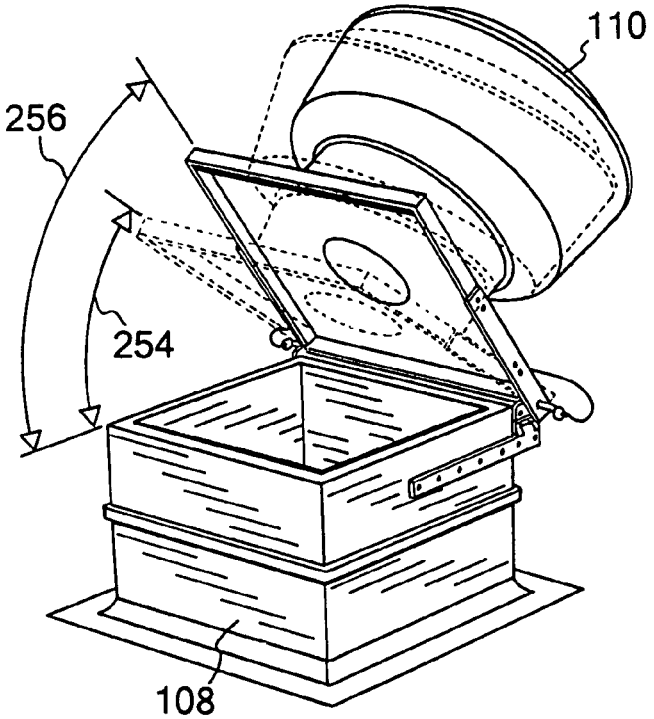
FIG. 24 depicts a frontal perspective view of flexible hinge assembly 200 with two open angles for easy maintenance.
Figure 25:
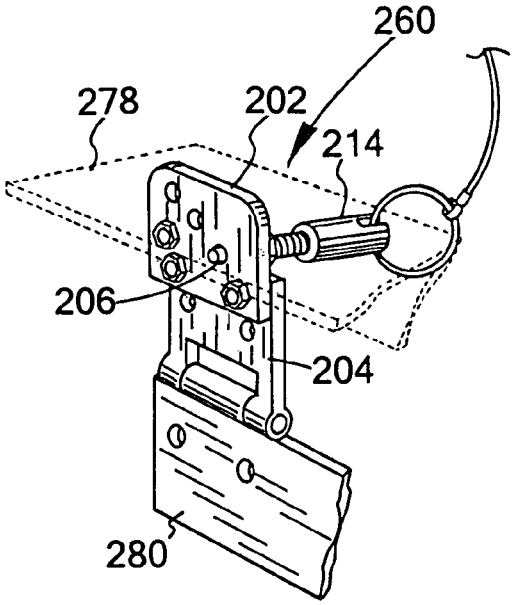
FIG. 25 depicts a front perspective view of flexible hinge assembly 200 in closed position 260.

Adding FIG. 24 and FIG. 25 to the consideration, the adjustability of flexible hinge assembly 200 can be clearly seen. Flexible hinge assembly 200 can adjust fan 110 to partially open position 254 and fully open position 256 in relation to vent wall 108. Finally, fan 110 can be placed in closed and locking position 252 and 260. Spring loaded threaded locking pin 214 can be placed in locking position 252 to further secure fan 110 in closed position 260. Closed and locked position 252 and 260 provides for great safety features from weather, changes in barometric pressure, wind, or other unforeseen conditions.

This application—taken as a whole with the abstract, specification, claims, and drawings being combined—provides sufficient information for a person having ordinary skill in the art to practice the invention as disclosed and claimed herein. Any measures necessary to practice this invention are well within the skill of a person having ordinary skill in this art after that person has made a careful study of this disclosure.

Because of this disclosure and solely because of this disclosure, modification of this method and device can become clear to a person having ordinary skill in this particular art. Such modifications are clearly covered by this disclosure.

What is claimed and sought to be protected by Letters Patent of the United States is:

1. A buttressed hinge assembly with combination with a fan assembly positioned on a roof vent structure, the roof vent structure being mounted around a vent on a roof, to provide for an easy cleaning and servicing procedure for both the fan assembly and the vent on the roof, the buttressed hinge assembly comprising:

a first hinge side cooperating with a second hinge side to form the buttressed hinge assembly, the first hinge side being similar in structure to the second hinge side, and each of the first and second hinge sides having:

a mounting support bar extending along a first axis, the mounting support bar configured to be securable to the roof vent structure, a hinge plate mechanism, a fan support bar configured to be securable to the fan assembly, a first pivot coupling pivotally connecting the mounting support bar to the hinge plate mechanism, the first pivot coupling configured to permit angular displacement of the mounting support bar relative to the hinge plate mechanism about a first axis, a hinge locking plate secured to the hinge plate mechanism, and a second pivot coupling pivotally connecting the fan support bar to the hinge locking plate, the second pivot coupling configured to permit angular displacement of the fan support bar relative to the hinge locking plate and thus the hinge plate mechanism about a second axis, wherein the second axis is transverse to the first axis, such that when the hinge plate mechanism and the hinge locking plate are connected to each other and further connected to the mounting support bar and the fan support bar, the fan support bar is movable in relationship to the mounting support bar and further configured such that the mounting support bar is angularly displaced separate from the angular displacement of the fan support bar and about a different axis.

2. The buttressed hinge assembly of claim 1, wherein:

the mounting support bar includes at least two apertures for securing the mounting support bar to a desired surface of the roof vent structure;

the fan support bar includes at least two apertures for securing the fan support bar to the fan; and the fan support bar includes at least two locking pin apertures for releasably securing the fan support bar in an orientation relative to the mounting support bar for cleaning and servicing of the fan as desired.

3. The buttressed hinge assembly of claim 2, wherein:

the at least two apertures for the mounting support bar include a plurality of apertures for selectively distributing a weight of the fan;

the at least two apertures for the fan support bar include a plurality of apertures for selectively distributing a weight of the fan;

the hinge locking plate includes at least two adjustment apertures;

the fan support bar includes a fan support bar locking pin aperture configured to cooperate with the at least two adjustment apertures; and the at least two adjustment apertures are configured to enable the fan support bar to be oriented in at least a first orientation relative to the hinge plate mechanism and a second different orientation relative to the hinge plate mechanism.

4. The buttressed hinge assembly of claim 3, wherein:

the second orientation is associated with either of a fully opened position and a partially opened position;

the second orientation provides for easy cleaning or service of the fan assembly and the vent; and a locking pin is mounted in the locking pin aperture.

5. The buttressed hinge assembly of claim 1, wherein:

the first and second hinge sides are disposed at opposite sides of a fan assembly and oriented such that the second axis of the first hinge side is collinear with the second axis of the second hinge side;

the mounting support bar of the first hinge side is configured to be angularly displaced in any of an inward direction toward the second hinge side and an outward direction away from the second hinge side.

6. The buttressed hinge assembly of claim 1, wherein the hinge plate mechanism of at least one of the first and second hinge sides includes a hinge locking plate and a hinge plate, wherein the hinge locking plate is configured to be removably securable to the hinge plate in any one of a plurality of different orientations for adjusting a position of the fan support bar relative to the mounting support bar.

7. The buttressed hinge assembly of claim 6, wherein the hinge locking plate and the hinge plate each include a right side and a left side, and the locking plate is configured to be removably securable to the hinge plate in either of: (i) a first orientation wherein the right side of the hinge locking plate engages the left side of the hinge plate, and (ii) a second orientation wherein the left side of the hinge locking plate engages the right side of the hinge plate.

8. A hinge assembly with combination with a fan assembly positioned on a roof vent structure, the roof vent structure being mounted near a vent on a roof, to provide for easy cleaning and servicing of both the fan assembly and the vent on the roof, the hinge assembly comprising:

a hinge plate mechanism including a hinge plate secured to a hinge locking plate;

a fan support bar configured to be mountable to the fan assembly, the fan support bar pivotally coupled to the hinge locking plate such that the fan support bar is angularly displaced from the hinge plate mechanism about a first axis, wherein the hinge locking plate is further configured to be releasably securable in a plurality of different orientations relative to the hinge plate such that when the hinge locking plate is unsecured to the fan support bar the fan support bar is moveable about the hinge locking plate about the first axis; and a mounting support bar pivotally coupled to the hinge plate about a second axis that is transverse to the first axis, wherein the mounting support bar is configured to be mountable to a surface of the roof vent structure, and the mounting support bar is configured to be angularly displaced to align with any one of a plurality of orientations of the surface of the roof vent structure and wherein such that when the hinge plate and the hinge locking plate are connected to each other and further connected to the mounting support bar and the fan support bar, the fan support bar is movable in relationship to the mounting support bar and further configured such that the mounting support bar is angularly displaced separate from the angular displacement of the fan support bar and about a different axis.

9. The hinge assembly of claim 8, wherein the mounting support bar is configured to be angularly displaceable between: (i) a first orientation wherein a mounting surface of the mounting support bar is aligned parallel to a surface of the roof, and (ii) a second orientation wherein the mounting surface of the mounting support bar is aligned to a surface of the roof vent structure extending perpendicular to the surface of the roof.

10. The hinge assembly of claim 8, wherein the fan support bar is configured to be releasably securable in any of a plurality of different angular displacements relative to the hinge locking plate, at least one of said plurality of different angular displacements corresponding to an open position, and for each open position, the hinge locking plate is configured to be releasably secured in at least two different positions relative to the hinge plate for selectively adjusting distribution of a weight of a fan assembly mounted to the fan support bar.

11. The hinge assembly of claim 8, wherein at least one of the plurality of different angular displacements of the fan support bar relative to the hinge locking plate corresponds to an open position, and for each open position, the hinge locking plate is configured to be releasably secured in at least two different positions relative to the hinge plate for selectively adjusting distribution of a weight of a fan assembly mounted to the fan support bar.

* * * * *